US006892904B2

(12) United States Patent
Osborn et al.

(10) Patent No.: US 6,892,904 B2
(45) Date of Patent: May 17, 2005

(54) GROUTING GUN APPARATUS AND METHOD

(76) Inventors: Karen Osborn, 8016 46th St., Lyons, IL (US) 60534-1837; Ronald A. Sabor, 8039 W. Christy Ave., Lyons, IL (US) 60534

( * ) Notice: Subject to any disclaimer, the term of this patent is extended or adjusted under 35 U.S.C. 154(b) by 0 days.

(21) Appl. No.: 10/420,086

(22) Filed: Apr. 22, 2003

(65) Prior Publication Data

US 2004/0211789 A1 Oct. 28, 2004

(51) Int. Cl.[7] ..... B65D 88/54

(52) U.S. Cl. ..... 222/327; 222/323; 222/325; 222/391; 222/568

(58) Field of Search ..... 222/323–327, 222/391, 568

(56) References Cited

U.S. PATENT DOCUMENTS 3,612,359 A * 10/1971 Sundholm ..... 222/199
4,083,428 A * 4/1978 Ness ..... 184/105.2
4,735,509 A 4/1988 Rausch
4,834,268 A * 5/1989 Keller ..... 222/327
4,946,081 A 8/1990 Jacobson
5,314,100 A 5/1994 Deaver
5,372,286 A 12/1994 King
5,381,931 A 1/1995 Chang
5,456,389 A 10/1995 King
5,595,327 A 1/1997 Dentler et al.
5,762,237 A 6/1998 Chang
6,152,332 A 11/2000 Funk
6,176,398 B1 1/2001 Chang
6,220,485 B1 4/2001 Chang
6,325,261 B1 12/2001 Webber
2001/0030207 A1 10/2001 Wemyss et al.
2001/0032862 A1 10/2001 Yenglin
2001/0048198 A1 12/2001 Dulin

* cited by examiner

*Primary Examiner*—J. Casimer Jacyna
(74) *Attorney, Agent, or Firm*—Vedder Price Kaufman & Kammholz, P.C.

(57) ABSTRACT

A method and apparatus for applying sealing material having a plunger with a flexible outer surface and with an expanded size and a compressed size and a cartridge for receiving grout having an inner void of substantially equal size to the plunger compressed size and a hand-squeezed driving mechanism for moving plunger along the inner void of the cartridge.

14 Claims, 5 Drawing Sheets

GROUTING GUN APPARATUS AND METHOD

BACKGROUND OF THE INVENTION

1. Field of the Invention

The invention relates generally to an apparatus and method for selectively applying grouting material directly to a targeted location.

2. Description of Related Art

Grout is widely used to fill the gaps and seal the joints between floor and wall tiles, etc. Grout is known to come in a wide variety of types and colors to fit the specific requirements of the grouting job to be performed. Grout is typically prepared at or near the time and location of the project to be performed. Generally enough grout is prepared to complete the grouting of an entire target surface or group of surfaces. Applying grout from the same batch assures that the appearance of the grout on such target surface or surfaces will appear uniform. Grout is typically applied by spreading a grout material on the surface of a tiled surface and working the grout into the joints. After the filling of the joints are complete, the excess grout is scrapped off the tile. Next, the tiles are wiped off using a damp sponge, cloth or other suitable item. In performing such cleaning, operators must be careful not to remove the grout that has been worked into the joints; otherwise the operator must repeat the grouting steps to repair the damage to the previously grouted joint.

Applicators have been developed to reduce the time needed to apply grout to a tiled area. Such applicators attempt to reduce clean up time by attempting to apply the grout directly to the joint itself while avoiding contact with the tile surfaces. For example, an applicator has been developed which uses plunger for forcing grout out of a nozzle under pressure into the gap between tiles to ensure a proper amount of grout is within the gap. This device includes a tube assembly having a piston passageway with a smooth cylinder bore wall and a threaded tip end and an open handle end with a detachable u-shaped hand grip assembly removably attached to the outside. Further, the tube assembly has a separate injector tube, nose piece and nozzle tip. Grout is forced out of the tube from the nozzle end, where, an operator, using two hands, grabs the u-shaped handle with one hand, and with the other hand, grabs the plunger handle and pushes on the plunger handle while pulling on the u-shaped handle end. The u-shaped hand grip assembly is removably attached to the outside of the tube assembly via a hose-type clamp. The hose-type clam has a screw and worm drive where the u-shape handle is slid over the tube assembly and the worm screw is tightened until the corresponding circular band is tightened sufficiently about the tube assembly such that it will remain static during the push-pull operation of the applicator. To remove the unshaped handle, the same worm screw is loosened until the circular band is sufficiently loose to slide off the tube assembly.

Although such device provides the advantage of providing a tool that allows for the directed and controlled release of grout to a desired gap between tiles, many drawbacks still remain. One area of concern is the difficulty in using this design. Here, an operator must use two hands to create the pressure for extruding the grout from the device. Further, the push-pull design of the device requires that an operator position themselves behind the length of the device at the end of the plunger handle, thus creating a corresponding distance between the operator's eye, and the gap being filled.

Further, each operator must go through a learning process as to how to operate such a unique mechanism.

Another area of concern is the time and effort needed to replace an empty tube. If an operator has assembled a series of pre-filled tube assemblies and wishes to sequentially switch from each used up tube assembly to a waiting pre-filled assembly, the operator must take the time and effort to set-aside the device, retrieve a separate tool (a screwdriver) to assist in removing the u-shaped handle, use the tool to loosen the u-shaped handle from the tube assembly, remove the handle from the tube, slide the handle around the new filled tube assembly, use the screwdriver to tighten the u-shaped handle about the tube, and reposition themselves behind the device to continue the grouting process.

Another area of concern is the cost of the tube assembly itself. The cost of an assembly tube includes the following: the material cost to provide sufficient structural integrity such that the tightening of the u-shaped device thereabout does not cause such a constriction which impedes the stroke of the plunger through the chamber located inside, the material cost to provide sufficient applicator tube integrity such that the push-pull motion about the device does not deform the applicator tube and otherwise negatively impede the use of the device, the material cost to include a platform-type component at the plunger end of the tube for providing structural support for the opening of the tube, and the manufacture and material costs associated with the production and design of a applicator tube having separate sections. In addition, this design includes an angled nose piece that does not provide for the extrusion of the grout therein resulting in the loss of such grout if discarded, or requires the time and energy to retrieve the remaining grout. Further, all the above costs are multiplied when it is desired to use multiple applicator tubes to complete a grouting operation.

Another area of concern is the reliability of the device. Because the tube is constructed of multiple parts, and the operation of the piston crosses a seam of such multiple parts, there is inherent reliability issues and wear-and-tear issues regarding the repeated crossing of such boundary by the internal plunger. Further, the lack of a centering mechanism for the shaft leading to the plunger, and the general instability of the overall push-pull design, each contribute to a torquing of the shaft and a resulting torquing of the plunger. Such torquing of the plunger raises issue of jeopardizing the seal upon such movements as well as the longer term wear-and-tear on the inner walls of the assembly tube and the plunger.

Other application devices, although not generally known to be used in conjunction with grouting operations, but generally known to be used with caulking operations, are caulking guns. Such caulking guns are hand-held devices using a griping-trigger assembly to control the movement of piston-plate mechanism to cause the extrusion of caulking material stored in an interchangeable caulking tube. Here, the caulking gun is a tool used to act upon a disposable caulking tube. Pre-filled caulking tubes are purchased for use and discarded after the pre-filled caulking material has been dispensed. The limited types and colors of caulks used allows manufacturers to easily and economically produce and sell such pre-filled caulking tubes. The caulking tube designs are typified by their use of a cardboard or plastic tube to form its outer/inner shell. At one end of the tube is an applicator tip. At the other end is an opening that exposes the full width of the inner shell. Inside the inner shell, although obscured by a push-plate, is the caulking material. The push-plate is a circular plate with a perpendicular boarder around its edge where the perpendicular boarder or sides extend down towards the open end of the tube. The push-plate is used to urge the caulking material down the inner shaft and out the applicator tip. The push-plate also provides an atmospheric seal between the caulking material and the empty portion of the inner shaft, allowing the caulking material inside to be stored for an indefinite time before its use.

Force is applied against the push-plate by a piston-plate mechanism, which forces the caulking material out of the application tip. The piston-plate mechanism is characterized by a shaft extending down the inner shaft of the caulking tube with a plate that contacts and pushes the push-plate. The push-plate provides the necessary wall-to-wall coverage to displace the caulk material down the inner shaft. It is not necessary that the piston-plate plate extend to the wall surfaces. The push-plate has its perpendicular sides extending down the open end of the tube. The piston-plate's plate is in contact with the surface of push-plate's circular plate beyond the edges of such perpendicular sides. The width of the piston-plate plate cannot extend from wall-to-wall, as the sides of the push-plate, having a certain thickness, are located there between. As such, any piston-plate plate must be smaller in diameter than the diameter of the inner tube and no greater than the diameter between the two perpendicular sides of the push-plate. In fact, the reason for the use of the push plate generally, is as a footing to prevent the piston-plate's piston from breaching, or breaking through, the push-plate barrier and contacting the caulking material itself.

One of the preferred caulking gun design includes the use of a gasket that is of a diameter larger than the diameter of the inner tube and which extends about the edges of the piston-plate plate. Further, this circular gasket is held in place by the use of two piston-plates sandwiched on either side of such gasket. The gasket is designed to extend from the edges of the piston-plate plates and extend partially along the perpendicular sides of the push-plate, so as not to exceed the ends of such perpendicular sides. This design provides a vacuum between the piston-plates and the push-plate such that a moving back of the piston-plate pulls the push-plate, via a vacuum therebetween, in a backward motion. Therefore, this design requires that the gasket does not extend to the walls of the tube, as this would interfere with both the vacuum attempted to be created between the two plates, and with the backward movement of the push-plate along the walls of the tube.

Another preferred caulking gun design does not alter the diameter of the plunger-plate, but adds a spring-like mechanism used in the retraction of the associated piston rod. Here again, this design uses a plunger plate that fits within the diameter of the perpendicular sides of the push-plate and does not use a gasket. This caulking gun design is concerned with retaining the caulking tube or cartridge within the caulking gun until it is intentionally released by the operator. One embodiment here introduces a spring-like plate behind the plunger plate that resists movement in the backward direction, when the plunger-plate is approaching the exit point of the caulking tube.

Yet another design proposes a interchangeable plunger-plate design where the caulking gun accepts either of two sized cartridges, namely a ¼ gallon or 1/10 gallon cartridge. Here, depending on the size of the caulking cartridge, either a smaller or larger plunger-plate is used. In both cases, the plunger-plates are standard size for their corresponding caulking cartridges. As such, they are designed to fit between the perpendicular walls of the corresponding push-plates, and do not contain a flexible gasket.

As demonstrated above, a need exists for a refillable, hand-squeezed driven grouting applicator. Desirably, the new apparatus is capable of dispensing grouting material without the use of a push-plate. Further it would be desirable if the new apparatus was capable of extruding the grout without the need for an operator to use two hands.

BRIEF SUMMARY OF THE INVENTION

A method and apparatus for applying sealing material is disclosed utilizing a plunger with a flexible outer surface and with an extended position and a compressed position. A cartridge for receiving grout has a chamber of substantially equal size to the plunger in its compressed position and a hand-squeezed driving mechanism for moving the plunger along the chamber of the cartridge.

DETAILED DESCRIPTION OF THE INVENTION

Figure 2:
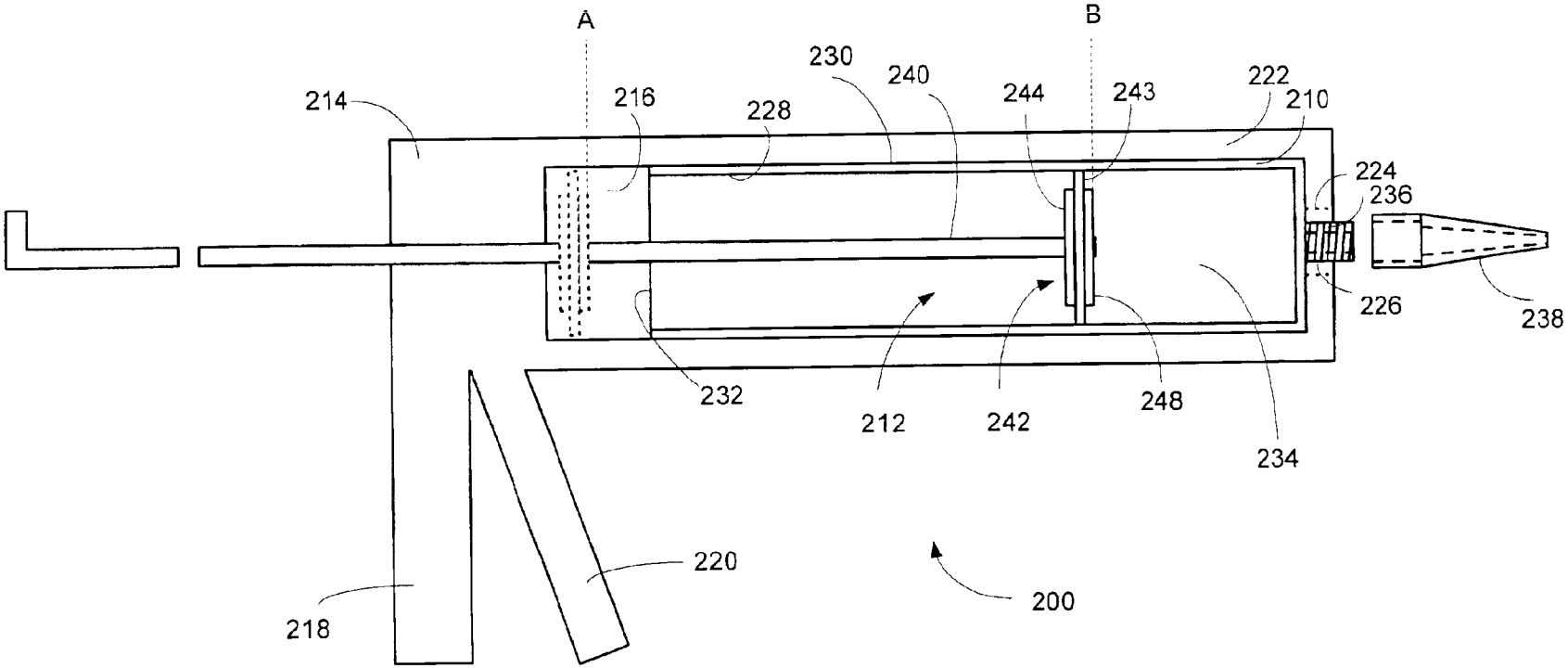
FIG. 2 is a cut-away side elevation view of one embodiment of a grouting gun.
Figure 3:
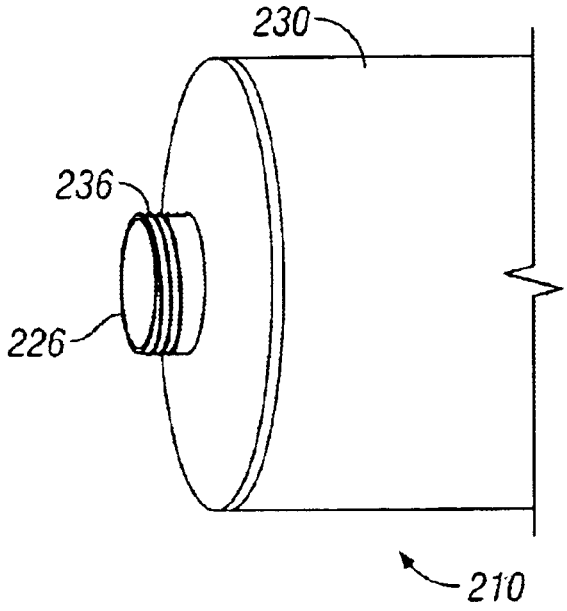
FIG. 3 is a front perspective view of a portion of the grout cartridge of one embodiment of the invention.

The embodiment shown in FIG. 2 includes the grouting gun 200, the grout cartridge 210, and the piston 212. In this embodiment, the grouting gun 200 contains similar components as found in typical caulking guns. One skilled in the art is generally familiar with the components of a typical caulking guns. Grouting gun 200 further comprises grouting gun housing 214, grout cartridge chamber 216, handle 218, trigger 220 and barrel 222. However, some embodiments (not shown) do not include a typical barrel 222 where the grout cartridge itself acts as the barrel 222 where the end of the grout cartridge 210 is screwed into, or otherwise secured to, the grouting gun housing 214.

Grout cartridge chamber 216 includes a grout cartridge access opening (not shown), and a applicator tip opening or aperture 224. Again, referring to the above described embodiment that is absent barrel 222, here cartridge chamber 216 is also absent, and such embodiment is therefore also absent such grout cartridge access opening and applicator tip opening 224. The embodiment shown in FIG. 2, like typical caulking guns, has a trigger 220 connected to a piston 212 such that repeated squeezing of the trigger 220 causes forward movement of piston 212 down barrel 222 and through grout cartridge chamber 216. This ability to generate the necessary force to move a piston by the hand-squeezing motion of one hand alone, hand-squeezing being the opposing forces generated from within the hand itself, allows for the other hand to perform other tasks at the same time that the other hand is generating this force. Other embodiments use other means to manually move piston 212 and include the transferring of a squeezing motion of the hand into the movement of such piston. For example, one embodiment, not shown, uses a dual trigger-type arrangement where handles and triggers on either side of a barrel are squeezed to produce the desired movement of the piston. As shown in FIG. 2, the barrel 222 has a grout cartridge chamber 216. Again, as discussed above, some embodiments are absent barrel 222 altogether.

Grout cartridge 210 is located in grout cartridge chamber 216 inside barrel 222 and includes nozzle 226, inner cartridge wall 228, outer cartridge wall 230 and piston opening 232. In this embodiment, the grout cartridge 210 is different than caulk cartridges found in typical caulking guns at least because there is no push-plate between the piston 212 and the sealing material. In addition, grout cartridge also contains grout 234 (sealing material). Also, in this embodiment, and unlike typical caulking guns, the grout cartridge 210 is designed to receive sealing material through its piston opening 232. Here, the grout cartridge 210 is made out of plastic so that it is easily cleaned. However, other embodiments include a grout cartridge 210 made of other materials such as of cardboard or metal. Further, in this embodiment, the grout cartridge 210 is designed to handle the structural demands of operating within a grout cartridge chamber, but is not designed to withstand those structural demands of grouting guns which simply attach to the open end of a grouting cartridge. Other embodiments with grout cartridges with thicker sidewalls and with greater structural integrity are used to withstand the inherent additional forces present in such grouting gun designs. The grout cartridge 210 has dimensions of approximately 10 inches long (not including a nozzle or applicator tip) and with an inside diameter of 2⅜ inches.

In addition, the grout cartridge 210 of this embodiment is also different than the typical caulk cartridges where the grout cartridge contains a nozzle 226 rather than a permanently attached applicator tip. As shown in FIG. 2, nozzle 226 protrudes from the front of barrel 222 within the applicator tip opening or aperture 224 and extends beyond the front of barrel 222 such that its threads 236 are exposed, (See FIG. 5), and such that applicator tip 238, (See FIG. 4), approximately 2½ inches long, may be attached thereto as shown. FIG. 2 shows the applicator tip 238 disengaged from and in front of nozzle 226. As shown in FIG. 5, other embodiments locate threads 236 inside nozzle 226 such that the applicator tip 238, (See FIG. 6), is subsequently screwed into, rather than onto, nozzle 226. Further, in other embodiments, (not shown), a lip is used instead of threads 236 such that the applicator tip is snapped on rather than screwed on.

Figure 4:
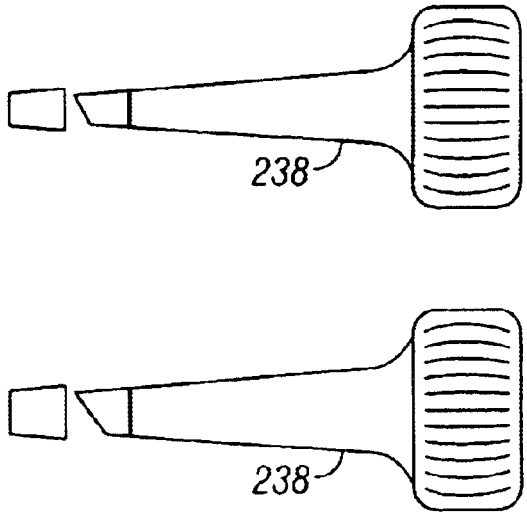
FIG. 4 is a side view of an application cap of one embodiment of the invention.
Figure 5:
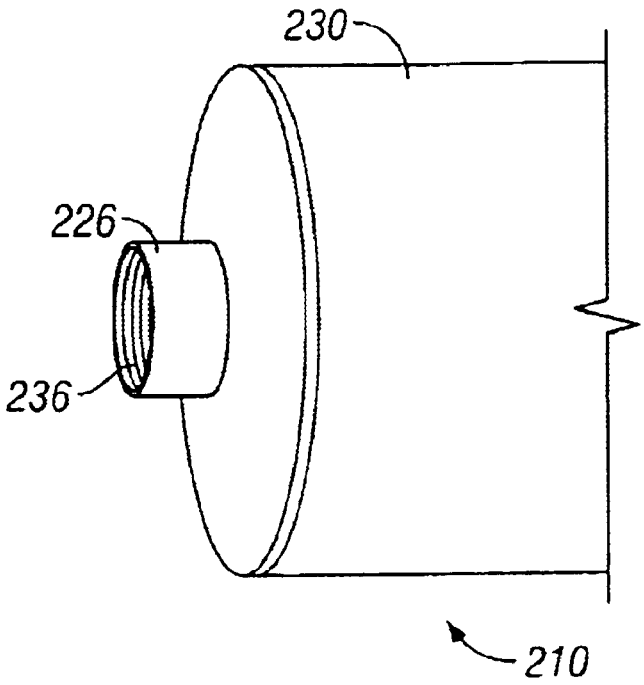
FIG. 5 is a perspective view of a portion of a grout cartridge of one embodiment of the invention.
Figure 6:
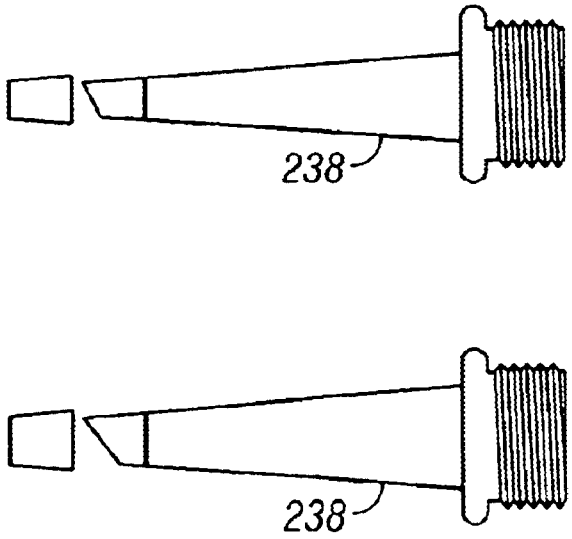
FIG. 6 is a side view of an application cap of one embodiment of the invention.

As shown in FIG. 4, this embodiment uses one of a multiple of interchangeable applicator tips 238 depending on the grouting job to be performed. Applicator tips are shown in FIGS. 4 and 6 as having openings of ¼ inch and ⅛ of an inch. Another embodiment, (not shown), which uses a permanently attached applicator tip, provides such a tip having an internal space that is increasingly larger towards the base of the applicator tip such that the applicator tip may be cut off at an appropriate position resulting in an opening of a desired width, for example, ¼ or ⅛ of an inch. Further, in the current embodiment, the amount of grout 234 that is available for use in grout cartridge 210 is, depending on which applicator tip 238 is used, ¼ inch or ⅛ inch, is 85 linear feet or 160 linear feet, respectively.

Figure 7:
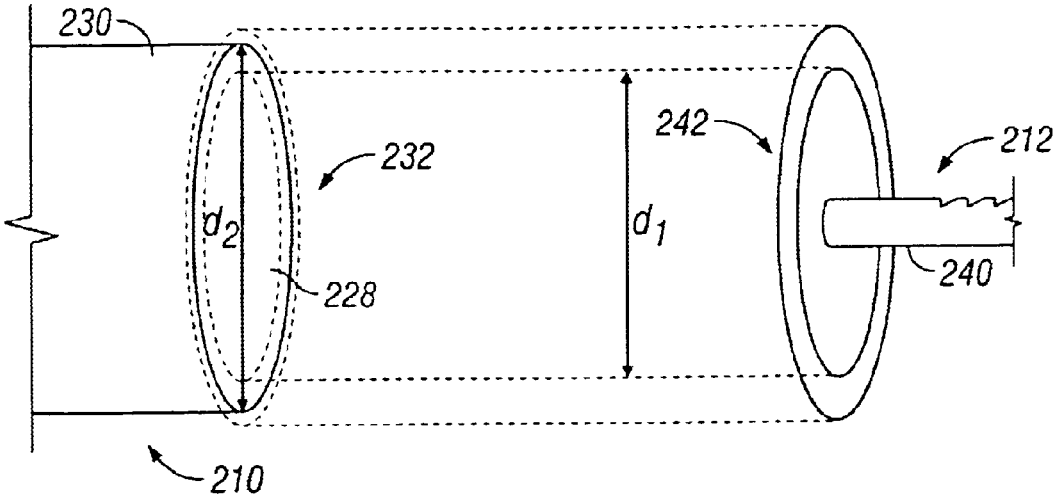
FIG. 7 is a perspective view of a plunger and a piston-end portion of a grout cartridge of one embodiment of the invention.

The inner cartridge wall 228, as shown in FIGS. 2 and 7, has a uniform and smooth surface such that piston 212 is capable of achieving and maintaining an airtight seal along the usable portion of the grout cartridge 210. Here, the term 'usable portion' is used to refer to that portion of the grout cartridge 210 that piston 212 is to both travel and be required to keep a seal with inner cartridge wall 228. Other embodiments, (not shown), do not require that the seal be airtight, but rather that the seal be sufficient to preclude an unreasonable amount of grout to pass to the non-grout side of the piston 210.

Figure 1:
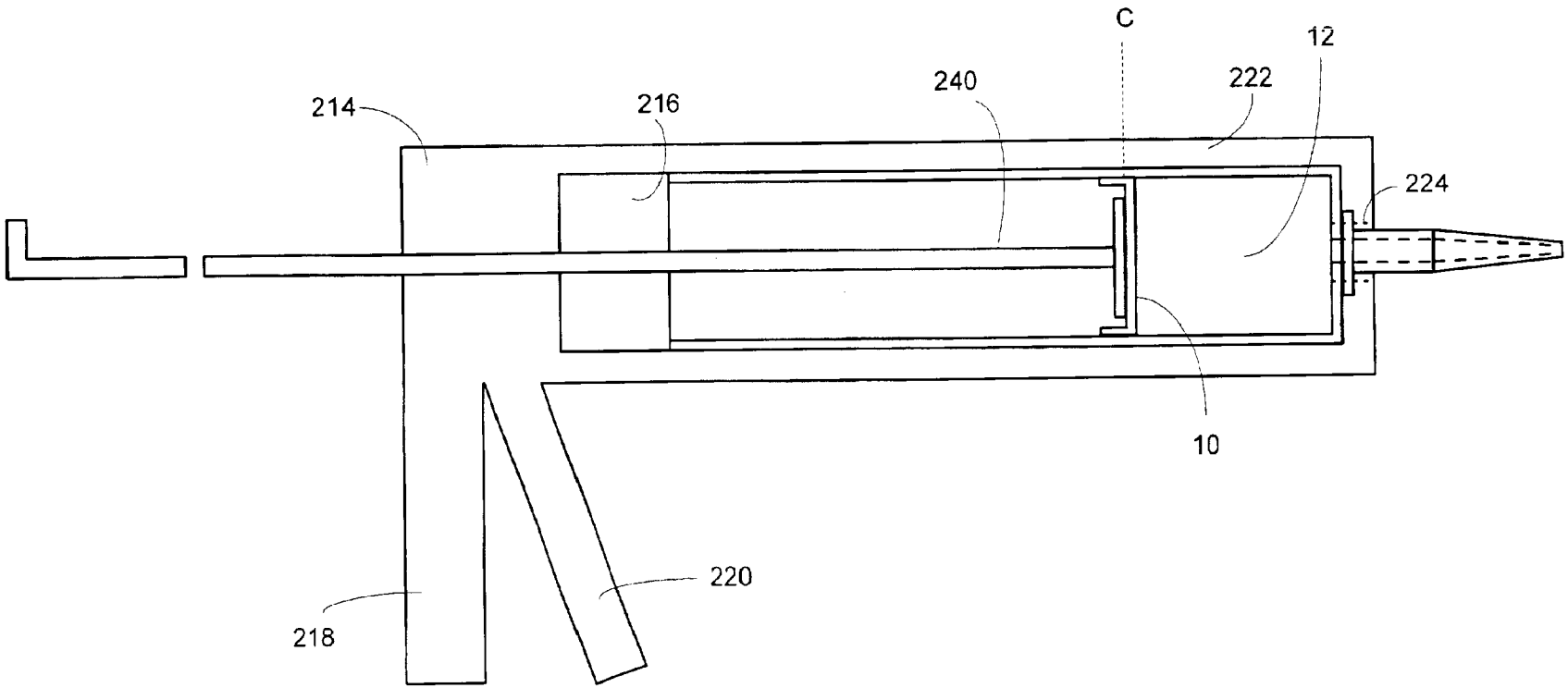
FIG. 1 is a cut-away side elevation view of a prior art caulking gun system.

As shown in FIG. 2, piston 212 is comprised of shaft 240 and plunger 242. In this embodiment shaft 240 is the same shaft as found in typical caulking guns. As such, the shaft 240 is operatively connected to trigger 220 such that the shaft 240 extends down the barrel 222 of the grouting gun 200 as the trigger 220 is repeatedly pulled. However, the plunger 242 is not typical of those found in caulking guns. The plunger 242 includes a gasket 243 which forms a flexible outer surface of plunger 242 and extends outward and contacts inner cartridge wall 228. Further, the plunger 242 is intended to directly contact the grout material. In contrast, and as shown in FIG. 1 plungers from typical caulking guns are intended to contact a push-plate 10 only, and it is the push-plate 10 that is in contact with the sealing material 12. Again referring to FIG. 2, the design of the plunger 242, includes a gasket 243 being sandwiched between two piston-plates 244 and 248 such that gasket 243 extends about the edges of such piston-plates and forms an airtight seal with inner cartridge wall 228.

Further, as shown in FIGS. 2 and 7, piston opening 232 is large enough to accept the entry of piston 212. As shown in FIG. 2, when the piston 212 is in position A rather than position B, or is otherwise outside of grout cartridge 210 as also shown in FIG. 7, the gasket 243 is not in contact with the inner cartridge wall 228, and as such is in an expanded state, or a relaxed position, such that its outer boundary extends beyond the inner cartridge wall 228 (e.g., $d_1$ is greater than $d_2$). The gasket 243 in its expanded position is approximately 2 13/32 inches in diameter. And when gasket 243 is in position B, within grout cartridge 210, e.g., within the inner void therein, the gasket 243 is in its compressed position where it conforms to the diameter equal to that defined by the inner walls 228 of grout cartridge 210. The gasket 243 in its compressed position is substantially the same diameter as that of the inner cartridge wall 228. It is this compressed nature, or the close tolerance associated therewith, where the plunger 242 is sized to produce an airtight seal with the inner cartridge wall 228 that allows for the efficient displacement of the grout down the grouting cartridge chamber 216 in the direction of the opening of nozzle 226. Other embodiments, (not shown), include a fluted end to assist in the compressed deformation of gasket 243. Although not shown, gasket 243 may experience deformation in an additional direction than in and inward radial direction, for example, in either direction along the inner cartridge wall 228.

Therefore, other embodiments exist that utilize a plunger 242 with the properties associated with this close tolerance, or otherwise provide the above described compressed and relaxed positions. For example, one embodiment uses a plunger 242 that is substantially made of rubber, and is of sufficient thickness as to provide the pushing force down grouting cartridge chamber 216 without deforming to a point which allows the grouting material to pass by the edges of plunger 242. Another embodiment is where a single metal piston plate is used that contains front and rear lips on its outside edge, where an o-ring is placed there between, and provides the airtight seal with inner cartridge wall 228 when inserted into grout cartridge 210.

Figure 8:
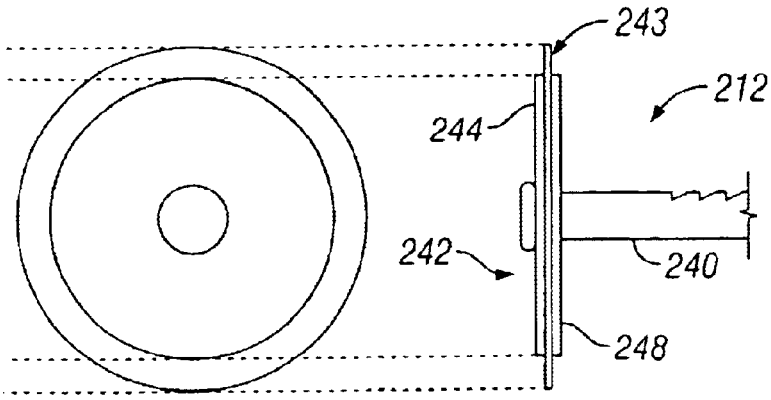
FIG. 8 is a side view and a front view of a plunger of one embodiment of the invention.

As best shown in FIG. 8, the piston-plates 244 and 248 of this embodiment are made of a rigid material metal such as steel. The diameter of each piston plate 244 and 248 in this embodiment is approximately 2 5/16 inches. What is essential is that the diameter of any such rigid piston-plate, 244 or 248, associated with the plunger be no larger than the piston opening 232. Other embodiments utilize other metals than steel, while yet other embodiments use rigid materials other than metal. What is less important than the rigidity of the inner portion of the plunger 242, is the overall capability of the plunger 242 to both force the grout material down the grout cartridge 210 and to maintain a significant seal with the inner cartridge wall 228.

In operation, the operator selects an applicator tip 238 to attach to grout cartridge 210. The selected applicator tip 238 is then twisted onto the nozzle 226 via threads 236 until it is sufficiently tightened. If grout cartridge 210 has not yet been filed with grout 234, the operator then fills it with grout 234. Because of the nature of grout, including, for example, that in comes in many types and colors, its tendency to harden, and that grout is often specifically mixed for a particular project, that it is generally expected that grout cartridges 210 would not be sold with a grout already pre-mixed and stored therein. Rather, it is generally expected that empty grout cartridges will be sold that will be subsequently filled at the project location by an operator. Next, the operator grabs the grouting gun 200, an embodiment thereof shown in FIG. 2, by handle 218. To avoid inadvertently spilling grout from the piston opening 232 of grout cartridge 210, and to otherwise take advantage of gravity in the preparation of grouting gun 200, the operator may point the barrel 222 of gun 200 towards the ground. With the hand not on the handle 218, the operator slides in grout cartridge 210 into the grout cartridge chamber 216 through the grout cartridge access opening in barrel 222 of the grouting gun 200. In doing so, the operator aligns the applicator tip 238 so that it enters applicator tip opening 224. Once the grout cartridge 210 has been inserted with applicator tip 238 protruding through applicator tip opening 224, then the operator may engage plunger 242 with grout cartridge 210.

Operator uses trigger 220 to move shaft 240 down the barrel 222 until the plunger 242 engages the outside edge of piston opening 232 of grout cartridge 210. As best shown in FIG. 7, the piston opening 232 in this embodiment provides the means for compressing the plunger portion of piston 212 as the piston enters grout cartridge 210. Here, although the diameter $d_1$ for the relaxed or expanded plunger 242 is larger than the diameter $d_2$ for the piston opening 232 in the back of grout cartridge 210, a force applied along piston 212 towards piston opening 232 causes an initial contact between gasket 243 and the grout cartridge 210, as the operator continues to squeeze the trigger 220 and the force down shaft 240 continues the gasket 243 is deformed in an inward radial direction until the plunger 242 is within grout cartridge 210. Once inside the grout cartridge 210 the gasket 243 assumes its compressed size. The trigger 220 is continued to be squeezed until the plunger engages the grout 234 and the grout 234 begins to emerge from opening in applicator tip 238.

Now that the grouting gun 200 has been readied for use, the operator then, by placing one hand on the barrel 222 and the keeping the other on the trigger 220, places the applicator tip 238 within the joint that is intended to be filled and squeezes trigger 220 while directing the applicator tip 238 along the length of the joint such that a desired amount of grout 234 is applied to the area within the joint. This ability to direct the precise amount of grout 234 to be applied to a targeted joint without otherwise depositing such grout 234 on the surrounding tile surfaces, provides the advantage of eliminating the need for a floater and the otherwise significant clean up time otherwise associated with cleaning up the grout 234 that remains on the tile rather than in the joints. The clean up time will be reduced to that of cleaning just the grouting gun 200 itself.

Once the process of filling the joints has been complete, or the operator wishes to temporarily end the current joint filling process, the operator need only apply a cap to the end of the applicator tip 238 and set aside the grouting gun 200 for later use. The seals at the applicator tip 238 and at the plunger 242 allow for the indefinite storage of the remaining grouting mixture which allows for the immediate initiation of a new grouting process without any preparation of the grouting gun as well as saving the cost of having to dispose of the grout 234 remaining at the time that the process is aborted.

Many of the embodiments discussed above are based on changes or improvements to existing designs for caulking guns. A number of such embodiments can be achieved by modifying the piston-plate portion associated with existing caulking guns. For example, one may remove the piston plate portion from the piston leaving just the shaft 240. The removed piston plate is generally characterized by its diameter which is smaller than the diameter of the piston opening $d_2$, and which otherwise lacks the ability to provide an airtight seal with the inner cartridge wall 228. Then, a plunger, such as the plunger 242 as shown in FIG. 8, is added to the end of shaft 240. Here, the plunger is capable of generating an airtight seal with inner cartridge wall 228 when inserted into grout cartridge 210. Finally, rather than inserting a caulk cartridge into the gun, a grout cartridge 210, having the properties discussed above, is instead inserted or loaded into the gun. The operation of such an apparatus is generally described above.

It should be noted that the insertion of a caulk cartridge into such a modified system using a plunger is not recommended for a number of reasons, including, but not limited to the following: the push-plates 10 found in most caulk cartridges are designed for use in conjunction with piston plates of the caulking gun design where contact between the two is designed to occur at a diameter significantly less that the diameter of the corresponding caulk cartridge opening; also the gasket 243 of plunger 242 is not designed to withstand the pressure that the perpendicular boarder of the push plate would cause; slippage may occur such that a portion of a gasket may remain in contact with a far edge of the perpendicular boarder of the push-plate, while an another edge may slip towards the contact side of the push-plate causing a torquing force about the push-plate potentially resulting in greater slippage resistance or potentially a total twisting of the push-plate resulting in a variety of complicating factors; and also in addition to the original internal design friction forces inherent between the push-plate and the inner sidewalls of the caulk cartridge, additional external design frictional forces are added between the contact of the new non-standard plunger 242 and the inner sidewalls.

While only a few embodiments and aspects of the invention have been described above, including the preferred embodiment, those of ordinary skill in the art will recognize that these embodiments and aspects may be modified and altered without departing from the central spirit and scope of the invention. Thus, the embodiments and aspects described above are to be considered in all respects as illustrative and not restrictive, the scope of the invention being indicated by the appended claims, rather than by the foregoing description, and all changes which come within the meaning and range of equivalency of the claims are intended to be embraced herein.

We claim:

1. A system for dispensing sealing material comprising:

a plunger;

the plunger having a flexible outer surface and having an expanded size and a compressed size;

a cartridge for receiving grout having an inner void of substantially equal size to the plunger compressed size; and hand-squeezed driving mechanism for moving the plunger along the inner void of the cartridge; said hand-squeezed driving mechanism comprising a trigger connected to a piston, said piston being constructed in a range such that repeated squeezing of said trigger causes forward movement of said piston through said cartridge, said plunger being fixedly attached to said piston.

2. The system of claim 1 wherein the plunger flexible outer surface is a flexible compound sandwiched between, and extending out from, two substantially rigid members.

3. The system of claim 1 wherein the cartridge further comprises inner walls and wherein the plunger flexible outer spice directly contacts the inner walls of the cartridge.

4. The system of claim 3 wherein the contact between the plunger and the inner walls of the cartridge form on airtight seal.

5. The system of claim 1 wherein the flexible outer surface is a rubberized compound.

6. The system of claim 1 wherein the cartridge has a nozzle extending therefrom.

7. The system of claim 6 wherein the nozzle has an inner surface containing threads.

8. The system of claim 6 wherein the nozzle has an exterior surface containing threads.

9. The system of claim 6 further comprising an applicator tip attached to the nozzle; said applicator tip being angled at approximately 15° to 45° its distal end to facilitate application of the sealing material.

10. The system of claim 9, wherein the applicator tip is one of sizes: ¼ inch and ⅛ inch.

11. An apparatus for dispensing sealing material comprising:

a plunger having a flexible outer surface wherein the plunger flexible outer surface having a relaxed size and a compressed size wherein the compressed size is approximately 2⅜ inches;

a cartridge for telescopically receiving said plunger; and a driving mechanism for selectively moving the plunger within the cartridge; said hand-squeezed driving mechanism comprising a trigger connected to a piston, said piston being constructed in a range such that repeated squeezing of said trigger causes forward movement of said piston through said cartridge, said plunger being fixedly attached to said piston.

12. The apparatus of claim 11, comprising:

a plunger border area extending inward from the flexible outer surface and a plunger inner area extending inward from the plunger border when the plunger border area is compressible.

13. The apparatus of claim 12, wherein the plunger border area is a rubberized compound.

14. The apparatus of claim 12, wherein the plunger inner area is substantially incompressible.

* * * * *